United States Patent [19]

Christie et al.

[11] 4,093,891

[45] June 6, 1978

[54] TRAVELING WAVE DEFLECTOR FOR ELECTRON BEAMS

[75] Inventors: Alvin Benson Christie, Dundee; Ronald Eugene Correll, Lake Oswego, both of Oreg.

[73] Assignee: Tektronix, Inc., Beaverton, Oreg.

[21] Appl. No.: 749,579

[22] Filed: Dec. 10, 1976

[51] Int. Cl.[2] ..... H01J 23/16; H01J 29/96

[52] U.S. Cl. ..... 315/3; 313/421; 315/3.6

[58] Field of Search ..... 315/3, 3.6; 313/421

[56] References Cited

U.S. PATENT DOCUMENTS

| | | | |
|---|---|---|---|
| 3,376,464 | 4/1968 | Loty et al. | 315/3 |
| 3,694,689 | 9/1972 | Odenthal et al. | 315/3.6 |
| 3,849,695 | 11/1974 | Piazza et al. | 315/3.6 |
| 3,916,255 | 10/1975 | Crandall | 315/3 |

FOREIGN PATENT DOCUMENTS

| | | | |
|---|---|---|---|
| 44-16,697 | 7/1969 | Japan | 313/421 |

*Primary Examiner*—Saxfield Chatmon, Jr.
*Attorney, Agent, or Firm*—Adrian J. LaRue; Kenneth M. Durk

[57] ABSTRACT

A broadband electron beam deflection apparatus particularly for a tube in which its electron beam can be focused, varied in position and varied in intensity, consisting in the form of a pair of helices each having a flat surface adjacent to the optical axis of the electron beam and also being precisely maintained in a diverging direction to such axis over the length thereof is provided. The apparatus consists of two individual helix assemblies each composed of separate components combined into a single unit in a manner whereby symmetry and desired characteristic impedance is controlled by the dimensions of the helix and having an end-to-end propagation time equal to the electron beam velocity due to the pitch and circumference of the helix.

7 Claims, 10 Drawing Figures

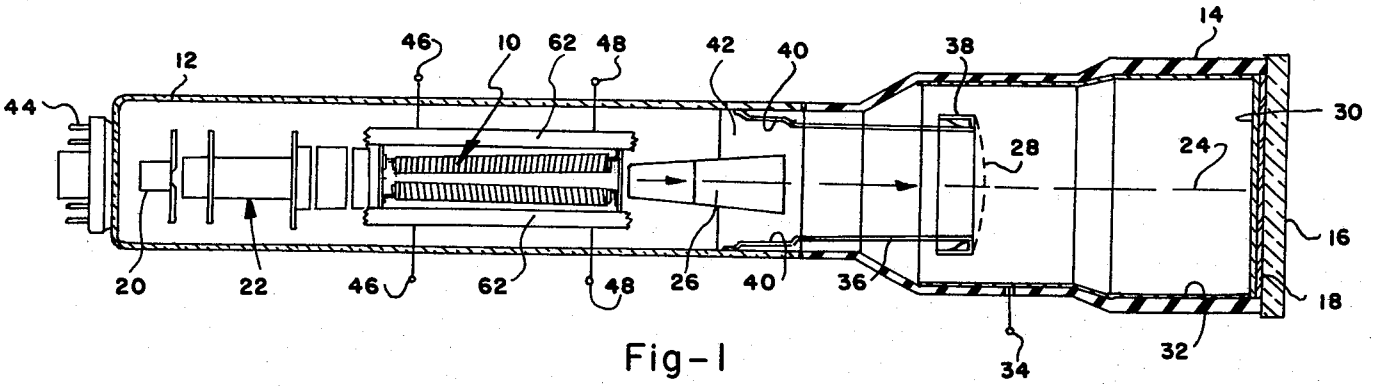
Fig-1
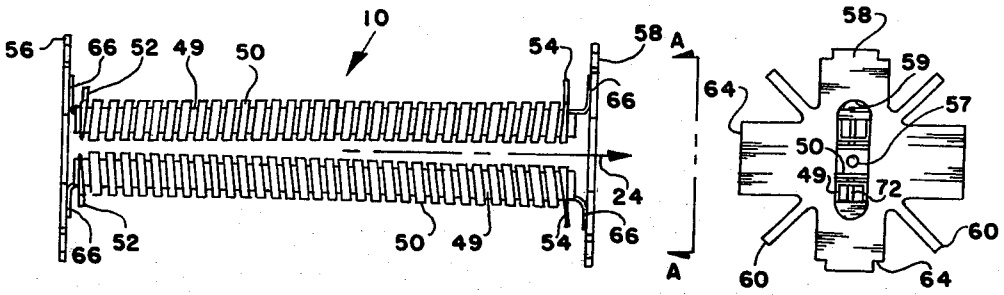
Fig-2A
Fig-2B
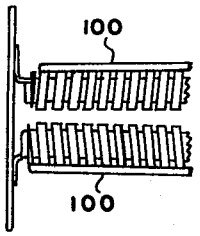
Fig-8

TRAVELING WAVE DEFLECTOR FOR ELECTRON BEAMS

BACKGROUND OF INVENTION

As is well known, any oscillographic instrument must surely include a cathode-ray tube (CRT) which is the output or display section. A cathode-ray tube generally consists of a triode section for furnishing a controllable source of electrons to a focusing section which focuses or forms the electrons into an electron beam. The electron beam is then deflected both vertically and horizontally in a deflection section and may be accelerated in an acceleration section to strike a phosphor-covered screen section with enough velocity that light is emitted by the phosphor.

As an apparatus for the deflection of an electron beam within a cathode-ray tube, though not exclusively, a typical conventional system may include a meander line of conductive material and an oppositely disposed ground electrode. When the meander line is excited, an electric deflection field is produced between the line and the ground electrode. If the phase velocity of the electric field traveling along the optical axis of the tube coincides or synchronizes with the velocity of the electron beam passing through the deflection field, the electron beam is deflected proportional to the strength of the electric field. However, the phase velocity of the electric field changes with an increase of the operating frequency so that the synchronization between the phase velocity and the velocity of the electrons cannot be maintained at a high operating frequency. This is, of course, a severe limitation of the deflection apparatus as it becomes impossible to observe signals on the screen of the cathode-ray tube which have frequencies higher than a certain limit value.

To overcome the disadvantage of the above described frequency limitation, there are systems which utilize a delay line type of deflection apparatus. For example, in U.S. Pat. Re. No. 28,223 to Odenthal et al there is described a deflection apparatus which includes a pair of helical deflector members having rectangular turns each having a pair of flat side portions separated by a deflector portion of different width. The system also includes two pairs of grounded adjustable compensator plates which are positioned adjacent the flat side portions on opposite sides of both helical members to form delay lines of substantially uniform characteristic impedance. This system therefore reduces the deflection signal velocity in the axial direction along the helical deflector until it is equal to the electron beam velocity to enable very high frequency signals to deflect the electron beam without appreciable distortion. However, this deflection apparatus requires that the compensator plates adjacent the flat opposite sides of both helical deflectors be precisely maintained in that to maintain the proper or desired characteristic impedance, the spacing from the deflectors is critical thereby complicating the construction techniques, as well as providing a structure which gives a rather weak and uneven surface to the beam side of the structure.

In others of these apparatus, for example U.S. Pat. Nos. 3,376,464 to Loly et al, 3,670,196 to Smith, 3,849,695 to Piazza et al, etc., there are described systems which give an adequate deflection of the beam for signals of a fairly high frequency, yet these apparatus permit the existance of a dispersion of the phase velocities which cannot be neglected.

SUMMARY OF INVENTION

To overcome the disadvantages of the known prior art, the present invention provides a deflection apparatus for the deflection of an electron beam within a cathode-ray tube, though not exclusively, which can be considered as a traveling wave helical deflector consisting of two individual helix assemblies each composed of three separate parts which are brazed together into a unit. The coiled stripline or helix is formed by folding a chemically milled, or cut, flat of stainless steel into a rectangular helix. On the inside of the stripline, and isolated electrically, is a stainless steel ground plane folded into a rectangular channel. The ground plane has a plurality of apertures that accomodate ceramic support pegs particularly metalized to reduce magnetic properties. These pegs are brazed to the helix on one end and the ground plane on the other. Thus the deflection apparatus according to the present invention has each turn of the helix solidly attached to the ground plane which precisely maintains the structure. Since good precision is obtained, the device provides good electrical symmetry thereby enabling broadband uses.

It is therefore an object of the present invention to provide a traveling wave deflector for electron beams which overcome the disadvantages of the prior art.

It is another object of the present invention to provide a broadband electron beam deflection apparatus for a cathode-ray tube which is capable of broadband operation.

It is still another object of the present invention to provide a deflection apparatus for the deflection of an electron beam consisting of a helical assembly composed of separate portions to precisely maintain the apparatus from the electron beam.

The foregoing and numerous other objects, advantages, and inherent functions of the present invention will become apparent as the same is more fully understood from the following description which completely describes and sets forth the best mode of the preferred embodiments contemplated by the inventors; it is to be understood, however, that the embodiments described are not intended to be limiting nor exhausting of the invention, but are given for purposes of illustration in order that others skilled in the art may fully understand the invention and principles thereof and the means of applying it in practical use so that they may modify it in various forms, each as best may be suited to the conditions of the particular use.

DESCRIPTION OF DRAWINGS

FIG. 1 is a longitudinal section view of a cathode-ray tube employing the deflection apparatus of the present invention;

FIG. 2, including FIGS. 2*a* and 2*b*, is a plan view, and an end plan view thereof, of the deflection apparatus used in the cathode-ray tube of FIG. 1;

FIG. 3, including

FIG. 8 is a plan view of another deflection apparatus according to the present invention.

DESCRIPTION OF INVENTION

Figure 3A:
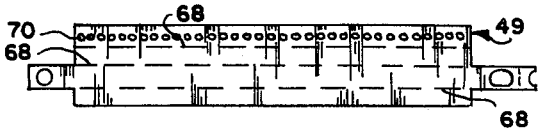
FIGS. 3*a* and 3*b*, is a view of the ground member portion of the deflection apparatus according to the embodiment of FIG. 2.

As shown in FIG. 1, an electron beam deflection apparatus 10 in accordance with the principles of the present invention is, say, contained within the evacuated envelope of a typical cathode-ray tube. The envelope includes a glass neck portion 12, a ceramic funnel portion 14, and a glass faceplate portion 16 which may be sealed together by glass to ceramic seals of devitrified glass, say, as shown in U.S. Pat. No. 3,207,936 of Wilbanks et al. A layer of phosphor material 18 forming the fluorescent screen of the tube is coated on the inner surface of the glass faceplate 16 at one end of the envelope. A cathode 20, which emits the electrons is provided at the other end of the envelope as well as the control grid and the focusing and acceleration anodes of a conventional electron gun generally indicated at 22 for forming the electrons emitted by the cathode 20 into an electron beam 24.

The electron beam 24, produced and formed by electron gun 22, is deflected in the vertical direction by the deflection apparatus 10 and subsequently is deflected in the horizontal direction by a pair of horizontal deflection plates 26 when deflection signals are applied thereto. After such deflection, the electron beam 24 is accelerated through a high electrical field so that it strikes the phosphor screen 18 with a high velocity to thereby cause said phosphor to exhibit phosphorescence. This post deflection acceleration field is produced between a mesh electrode 28 and an acceleration electrode 30 in the form of a thin electron transparent aluminum layer coated over the inner surface of the phosphor screen 18 and electrically connected to a conductive layer 32, say, of gold coated on the inner surface of the ceramic funnel 14. The electrode layer 32 terminates just to the left of the mesh electrode 28 and is electrically connected through a lead-in connector 34 to, say, an external source of high positive DC supply voltage.

The mesh electrode 28 is generally connected to ground through a support cylinder 36 attached at one end to a mounting ring 38 on which the mesh electrode 28 is supported and attached at its other end to spring contacts 40 which engage a conductive layer 42 coated on the inner surface of the glass neck 12 of the envelope. The mesh electrode 28 is connected to the average output voltage of the horizontal deflection plates 26 which is usually ground, and therefore provides a field free region between it and the output ends of the horizontal deflection plates 26.

The electrodes of the electron gun 22 and the mesh electrode 28 are connected to the exterior of the envelope through base pins 44 extending through the left end of the neck portion 12 of the envelope. However, the helical deflection members in deflection apparatus 10 to be hereinafter described, are connected to neck pins 46 and 48 extending through the side of neck portion 12. The neck pins 46 and 48 are electrically attached to the input end and the output end of each helical deflection member, respectively. The horizontal deflection plates 26 are also connected to neck pins (not shown) which extend through the envelope neck portion.

As shown in FIG. 2, the electron beam deflection apparatus 10 of the present invention includes a pair of helical wound deflection members 50 placed on opposite sides of the path of the electron beam 24 in a symmetrical manner. Each of the deflection members 50 has a plurality of spaced rectangular turns which are supported about a grounded conductive sheet 49 in the form of a rectangle disposed in coaxial relationship inside the deflection members 50. The input ends of the helical deflectors are connected through input leads 52 to the neck pins 46 while the output ends of such deflectors are connected through output leads 54 to neck pins 48. It should be noted that the helical deflectors 50 diverge apart at their output ends and such divergence or flaring starts to occur in accordance with the cathode-ray tube characteristics but preferrably starts at the input end and continues down the length of such deflectors to the output end. It could, for example, have helical deflectors which begin to diverge about one-half way down the length of such deflectors, or which do not diverge but are parallel.

The helical deflectors 50 are provided with input and output support and isolation shields 56 and 58 provided at the opposite ends of the vertical deflection system. In the preferred embodiment according to the present invention, the input support and isolation shield 56 includes an orifice 57 as shown in FIG. 2*b* which is taken along the line AA of FIG. 2*a* which enables the electron beam 24 to enter into the deflection area. The output support and isolation shield 58 also includes an orifice, but has been so dimensioned to enable maximum deflection or scan of the phosphor material 18. For example, the orifice 59 can be in the form of a cylinder having a cross-section consisting of two semicircles linked by two straight segments. Each support and isolation shield is further provided with a plurality of fingers 60 formed as an integral portion thereof and are embedded into glass support rods 62 (see FIG. 1) which may extend down the entire length of the electron gun to support the other elements of the gun in a similar manner. As an alternative to supporting the deflection apparatus from glass support rods that extend down the entire length of the electron gun, the support rods may need only extend between the input and output support and isolation shields 56 and 58 if additional support sections 64, also an integral portion of the support and isolation shields, are embedded into the glass neck portion 12. In the preferred embodiment of the invention, the fingers 60 are embedded into glass support rods which extend down the entire length of the electron gun as well as having portions 64 embedded into the glass neck portion 12.

As also shown in FIG. 2, the grounded planar conductive sheet 49 has tabs which are spot welded at welds 66, during manufacture, and before welding enables adjustment of the helical deflectors to the desired configuration, flaring, etc. Utilizing conventional techniques, sheet 49 is then electrically connected to additional neck pins (not shown) for grounding purposes via the support and isolation shields 56 and 58.

Figure 4:
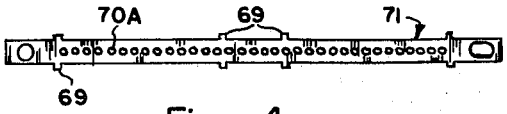
FIG. 4 is a view of the alignment member portion of the deflection apparatus according to the embodiment of FIG. 2.
Figure 3B:
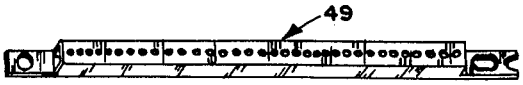

As shown in FIG. 3 each planar conductive sheet 49 is formed from a metal sheet of preferably "305" stainless steel about 10 mills thick and which is cut, or etched, to provide a plurality of metal strips which are each bent along dashed lines 68 and subsequently welded together to form a rectangular shape therealong. It should be noted that the rectangular form or shape of the ground member is for manufacturing purposes but should not be considered as limiting the invention thereto. A plurality of holes 70 are also spaceably provided along the length thereof. Disposed inside the rectangular form, and in spaced relationship thereto, is an alignment member 71 shown in FIG. 4 and formed from a metal sheet also "305" stainless steel about 10 mill thick, which is cut, or etched, to provide a plurality of tabs 69 which are each bent at approximate right angles to the sheet to form a means for maintaining the alignment member in spaced relationship to the sheet 49. A plurality of holes 70A are also spaceably provided along the length thereof.

Figure 5:
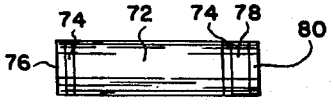
FIG. 5 is a view of one of the support pegs of the deflection apparatus according to the embodiment of FIG. 2.

In FIG. 5, there is shown a ceramic or nonconductive member 72, preferrably alumina of circular cross-section and whose diameter is such that it may be passed through holes 70 and 70A, each of which is in alignment in an assembled state. Each end of the member 72 is subjected to a refractory metal metalizing process which is, of course, a well known thick-film metalizing process to provide a metal layer 74 on each end of the member 72 which are bonded to the ceramic. Following the forming of metal layers 74, the member is subjected to a process whereby one end is coated with nickelous-oxide and fired in hydrogen which reduces the nickelous oxide to a nickelous layer 78. The firing in hydrogen seals and bonds the nickle to one of the layers 74 which, in turn, is easily wetted by, say, silver. A next layer 80 is then provided by applying a thick-film layer of silver over the layer 78 which is subsequently fired in hydrogen to bond the layers 78 and 80 together. The other end of the member 72 is subjected only to a process whereby a layer 76 of silver is bonded to one of the layers 74; the obviousness of only having two layers on one end of the member is necessary to minimize magnetic properties.

Figure 6:
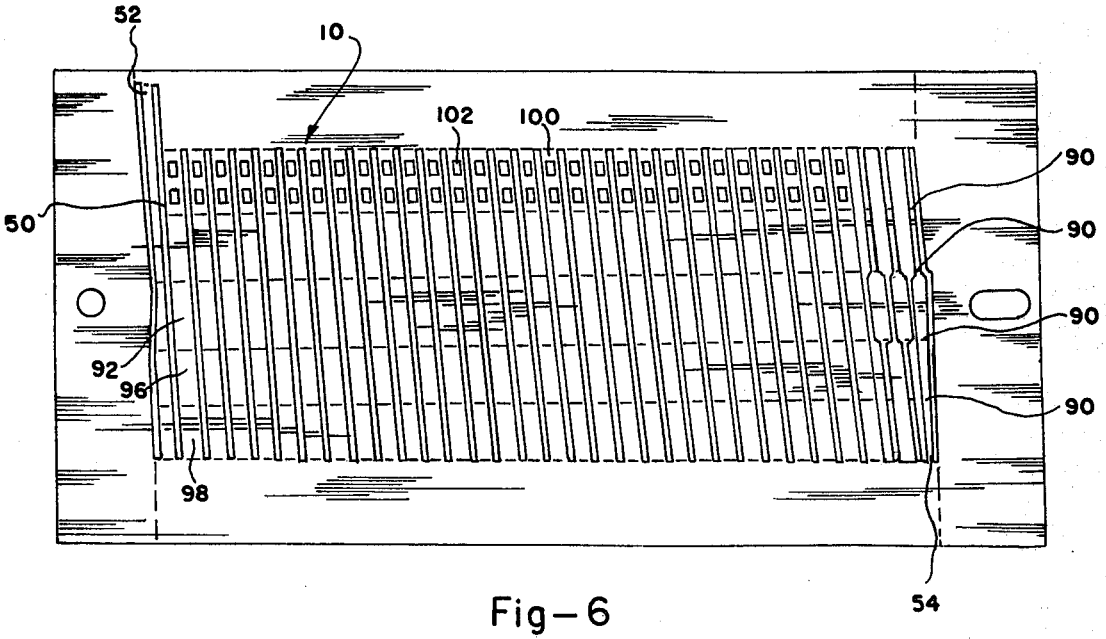
FIG. 6 is a plan view of a metal sheet member which is used to form one of the deflector members according to the embodiment of FIG. 2 before it is bent into the helican shape.

Attention is now directed to FIG. 6 wherein it can be seen that each of the helical wound deflector members 50 is formed from a metal sheet also "305" stainless steel about 10 mills thick which is cut, or etched, to provide a plurality of metal strips which are each bent along dashed lines 90 and subsequently welded together in series to form the rectangular turns of the helical deflector member 50. Any suitable method can be employed such as that shown in U.S. Pat. No. 3,322,996. Each of the rectangular turns includes a deflection portion 92 extending between a pair of flat top and bottom portions 94 and 96, an outer portion 98, and a lapping portion 100 for connecting two adjacent turns together. Lapping portion 100 includes a plurality of apertures 102 which enable the removal of occluded gases during the welding together of the deflection members.

The width in the beam direction of the above mentioned deflector portions does not increase successively along the path of the electron beam nor does the spacing between portions decrease along the path of the electron beam. Also, the width of the deflection portions 92 and the spacing, which is preferably about $0.014 \pm 0.002$ inches for the particular cathode-ray tube utilizing the present invention, between adjacent deflection portions remain substantially constant along the length of the deflector. An exception to the above is the input portion forming input lead 52 and about the last three turns of portions 94, 96, 98 and 100. These portions are of less width than the others to provide a high inductance and low capacitance turn portions which compensates for inductance and capacitance characteristics of the deflection portions. This, of course, maintains a desired characteristic impedance of the line, and reduces dispersion and reflection effects.

Figure 7:
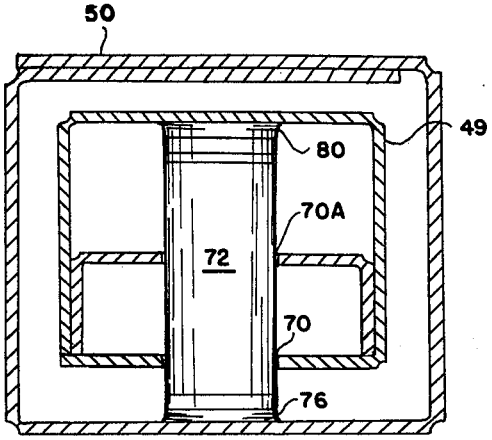
FIG. 7 is a cross-sectional view of the deflection apparatus according to the embodiment of FIGS. 1 and 2.

As shown in FIG. 7 and which has be previously stated, each helical deflector consists of two helical assemblies which are welded into a single unit. This unique construction technique thereby provides a precision flat surface on the beam side of the structure which is electrically suitable for broadband operation. As can be discerned from the figure, member 72 passes through the holes 70 and 70A and has its three layer end in communication with the inner portion of ground sheet 49 and is also held in alignment by member 71. The layer 80 is brazed to the sheet 49 in a conventional manner. Completely surrounding the sheet 49 is the helical deflection members 50 and such members are brazed to the layer 76 of the ceramic member 72. In the preferred embodiment of the apparatus the ceramic member 72 is about 2.815 inches in length and allows for about a 25 thousandeths-inch separation between the members 50 and 59. It can therefore be seen that an air dielectric transmission line has been formed whose characteristic impedance is determined by:

$$Zo = [100][1/(\log_e X - \log_e Y)] \text{ ohms,}$$

where $X$ is the distance across each spaced turn and $Y$ is the distance between the outer surface of the ground support and the inner surface of the spaced turn. (Note: In the preferred embodiment, $Zo$ is approximately 100 ohms and the ratio of X:Y is in the range of between 2 and 3.

In addition, and as has been previously stated, the pitch (turns/inch) and circumference of the deflection device determines whether the end-to-end propagation time is equal to the electron beam velocity and, as is well known, the velocity of the electron beam is dependent upon several well-known variables. Since the deflecting signal is applied to an air dielectric transmission line, it is traveling at the speed of light and must therefore traverse around the circumference of the members so that the time of its speed from one part on any spaced turn to an identical part on a successive turn is identical to the speed of the electric beam traveling between these two points. Since each cathode-ray tube has its own beam velocity, the deflection circumference must be adjusted accordingly.

Referring now to FIG. 8, there is shown in cross-sectional view another embodiment of the deflection apparatus 10 that has been shown to increase the bandwidth of the deflection apparatus to even higher limits. This embodiment is exactly as that already disclosed except that a pair of dielectric members 100, preferrably ceramic, have been placed adjacent the spaced turns and along the length thereof. These dielectric members, or compensator plates, are believed to effectively reduce capacitance effects between each of the deflection members when the deflection members are positioned adjacent to each other.

Also, these members further provide means of maintaining each of the spaced turns of the apparatus in positive relation with adjacent turns, etc. It has also been demonstrated that by increasing the thickness of the dielectric members, the members need only be bonded to, say, every other turn along the length thereof whereas a member less thick needs bonding to every turn along the length thereof. Since the ceramic to metal bonding process has already been discussed in relation to the ceramic pegs, no further discussion thereof is believed necessary. Additionally, the dielectric member enables the narrowing of the output turns of the deflector to be primarily dispensed with.

While there has been shown and described the preferred embodiment according to the present invention, it will be apparent to those skilled in the art that many changes and modifications may be made from the invention in its broader aspects. For example, the deflection apparatus 10 can be used in other cathode-ray tubes including charge image storage tubes having transmission type mesh storage targets or simplified sotrage targets of a phosphor layer and target electrode coated on a glass support plate. Other uses may be desirable wherein the deflection apparatus 10 is utilized to deflect the beam horizontally. In addition, the members 50 and 49 nead not necessarily form a rectangle in that other shapes could be utilized. Therefore, the appended claims are intended to cover all such changes and modifications that fall within the true spirit and scope of the invention.

The invention is claimed in accordance with the following:

1. A traveling wave deflector for deflecting an electron beam emitted from a source of electrons, comprising:

a pair of helical deflection members, each of said members having a plurality of spaced and substantially flat conductive ribbon turns positioned along and spaced relative to an axis of the electron beam and on opposite sides thereof;

a ground member disposed in coaxial relationship inside each of said helical deflection members and being supported in spaced relationship thereto; and means for insulatively supporting said ground member and said deflection members in said spaced relationship, said means disposed inside each of said helical deflection members.

2. The deflector according to claim 1 wherein said means for supporting defines spaced peg means, each of said peg means having one end bonded to an inner surface of each of said spaced turns and the other end bonded to said ground member.

3. The deflector according to claim 1 further comprising a dielectric member selectively bonded to an outer surface of said helical deflection members.

4. The deflector according to claim 1 further comprising:

first and second isolation and support means coupled to said ground member for positively positioning said deflection members relative to the axis of the electron beam, both said first and said second isolation and support means including means for passing the electron beam.

5. The deflector according to claim 4 wherein said deflection members are positioned in a diverging manner relative to said axis of said electron beam.

6. An electronic scanning device, comprising:

an evacuated envelope;

an electron gun including electron emissive means and forming means positioned in one end of said envelope for projecting a beam of electrons;

electron collecting means positioned at the opposite end of said envelope; and deflection means positioned between said electron gun and said electron collecting means for deflecting said beam of electrons, said deflection means including a traveling wave deflector having a pair of helical deflection members each having a plurality of spaced and substantially flat conductive ribbon turns positioned along and spaced relative to an axis of the electron beam and on opposite sides thereof, a ground member disposed in coaxial relationship inside each of said deflection members and being supported in spaced relationship thereto, and means for insulatively supporting said ground member and said deflection members in said spaced relationship, said means disposed inside each of said helical deflection members.

7. The electronic scanning device according to claim 6 further comprising:

first and second isolation and support means coupled to said ground member for positively positioning said deflection members relative to the axis of said beam of electrons, both said first and said second isolation and support means including means for passing the electron beam.

* * * * *